US005706685A

United States Patent [19]

Chedru

[11] Patent Number: 5,706,685

[45] Date of Patent: Jan. 13, 1998

[54] FORMING PRESS HAVING AN ELASTIC MATRIX

[75] Inventor: Philippe Chedru, Savenay, France

[73] Assignee: GEC Alsthom ACB, Paris, France

[21] Appl. No.: 576,310

[22] Filed: Dec. 21, 1995

[30] Foreign Application Priority Data

Dec. 22, 1994 [FR] France ..... 94 15487

[51] Int. Cl.[6] ..... B21D 22/10

[52] U.S. Cl. ..... 72/57; 72/446; 72/460

[58] Field of Search ..... 72/57, 446, 448, 72/460

[56] References Cited

U.S. PATENT DOCUMENTS

| | | | |
|---|---|---|---|
| 2,984,176 | 5/1961 | Sommer et al. . | |
| 3,111,100 | 11/1963 | Georgeff | 72/446 |
| 3,134,350 | 5/1964 | Danly et al. . | |
| 3,422,662 | 1/1969 | Guess | 72/488 |
| 3,456,481 | 7/1969 | Zeitlin | 72/446 |
| 5,272,898 | 12/1993 | Dittlo et al. | 72/57 |

FOREIGN PATENT DOCUMENTS

| | | | |
|---|---|---|---|
| 252344 | 6/1963 | Australia | 72/57 |
| 1271662 | 7/1968 | Germany . | |
| 390226B | 4/1990 | Germany . | |
| 1349833 | 11/1987 | U.S.S.R. | 72/57 |

*Primary Examiner*—David Jones

*Attorney, Agent, or Firm*—Sughrue, Mion, Zinn, Macpeak & Seas, PLLC

[57] ABSTRACT

An elastic matrix forming press comprising a frame including at least a bottom beam and a top beam united by link means, an actuator bearing against the bottom beam, and a forming assembly comprising an anvil resting on the piston of the actuator, a tool-carrier table, and a container including an elastic cushion engaged against the top beam, wherein said forming assembly: anvil, tool-carrier table, container, and elastic cushion, includes means enabling it to be exchanged for another having a tool-carrier table of different area, the section of said tool-carrier table corresponding to the inside section of the container.

6 Claims, 5 Drawing Sheets

1
2
3
4
5
6
7
8
9
10
11
12
13
14
15
16
17
18
19

1
10
11
12
13
6
7

FORMING PRESS HAVING AN ELASTIC MATRIX

The present invention relates to a forming press having an elastic matrix.

BACKGROUND OF THE INVENTION

In conventional stamping, it is known that the stamping tool comprises a male portion and a female portion between which the workpiece to be stamped is formed. Forming with an elastic matrix consists in simplifying the tool by reducing it to a single portion, male or female, and in replacing the other portion with an elastic matrix. The main advantage comes from the resulting saving since only one half-tool needs to be manufactured for each different series of workpieces.

The elastic matrix is either an elastomer cushion, or else a bladder filled with liquid. The machine is dimensioned as a function of the maximum size of workpiece it is to form. In addition, the machine is also designed to withstand a maximum forming force that corresponds to the maximum forming pressure that needs to be applied to the workpiece of maximum size. Also, the pressure required for forming depends on various parameters: the material of the workpiece, its thickness, and the forming radii.

However, workpieces of maximum size represent only a small fraction of all of the workpieces to be formed.

Forming machines of the above type comprise a frame that withstands the forming forces and that generally comprises a top beam, a bottom beam, and between the beams both an actuator that bears against the bottom beam and whose piston supports an anvil in turn supporting a tool-carrier table for receiving various forming tools on which sheets to be formed are placed, and a container bearing against the top beam and containing the elastic cushion acting as the elastic forming matrix in cooperation with a tool supported on the tool carrier table.

During forming, and whatever the size of the tool resting on the tool-carrier table, the pressure exerted by the forming matrix (the elastic cushion) is exerted over the entire area of the table which penetrates into the container.

OBJECT AND SUMMARY OF THE INVENTION

An object of the present invention is to provide a machine that is cheaper by limiting the force the machine has to provide, and thus limiting the strength required of its frame. This is naturally achieved at the cost of a compromise which means that for large workpieces, the forming pressure exerted is less than that required for obtaining a finished piece without manual retouching. Thus, for such workpieces, which represent only a small fraction of total production, manual retouching after the machine-forming operation is accepted.

According to the invention, this object is achieved by a machine that includes an interchangeable forming assembly.

The invention thus provides an elastic matrix forming press comprising a frame including at least a bottom beam and a top beam united by link means, an actuator bearing against the bottom beam, and a forming assembly comprising an anvil resting on the piston of the actuator, a tool-carrier table, and a container including an elastic cushion engaged against the top beam, wherein said forming assembly: anvil, tool-carrier table, container, and elastic cushion, includes means enabling it to be exchanged for another having a tool-carrier table of different area, the section of said tool-carrier table corresponding to the inside section of the container.

Thus, when workpieces of small size are to be formed, a forming assembly is used that has a tool-carrier table of small area, thereby making it possible to apply very high forming pressure since the pressure is applied to a table of small area only, whereas in a machine having a non-interchangeable forming assembly that is dimensioned to receive large workpieces, the pressure applied is always exerted on a table of large size, regardless of the size of the workpieces to be formed, and as a result the maximum force the machine can exert must be very large.

With the invention, the machine is restricted to a much smaller force, but that does not prevent it from forming small- and medium-sized workpieces with the pressure required for proper and complete forming, since the pressure is exerted via a table of small area only, while for large workpieces, the pressure used is pressure that is compatible with the maximum acceptable force for the machine, and given the area over which the force is applied via a tool-carrier table of large size. Under such circumstances, if the forming pressure used is less than the optimum forming pressure, it is necessary to finish off the workpiece manually in order to obtain proper and complete forming.

This provides large savings in respect of the machine since it can be designed to withstand forces that are much smaller than those that would be necessary for a machine with a forming assembly that is not interchangeable.

According to another characteristic, the anvil is fitted with running wheels including means enabling them to be placed either in a retracted position within the anvil or else in an extended position.

According to another characteristic, said container is held fixed to said frame by releasable latches.

BRIEF DESCRIPTION OF THE DRAWINGS

An embodiment of the invention is described below with reference to the accompanying drawings, in which.

MORE DETAILED DESCRIPTION

Figures 1, 2, 3:
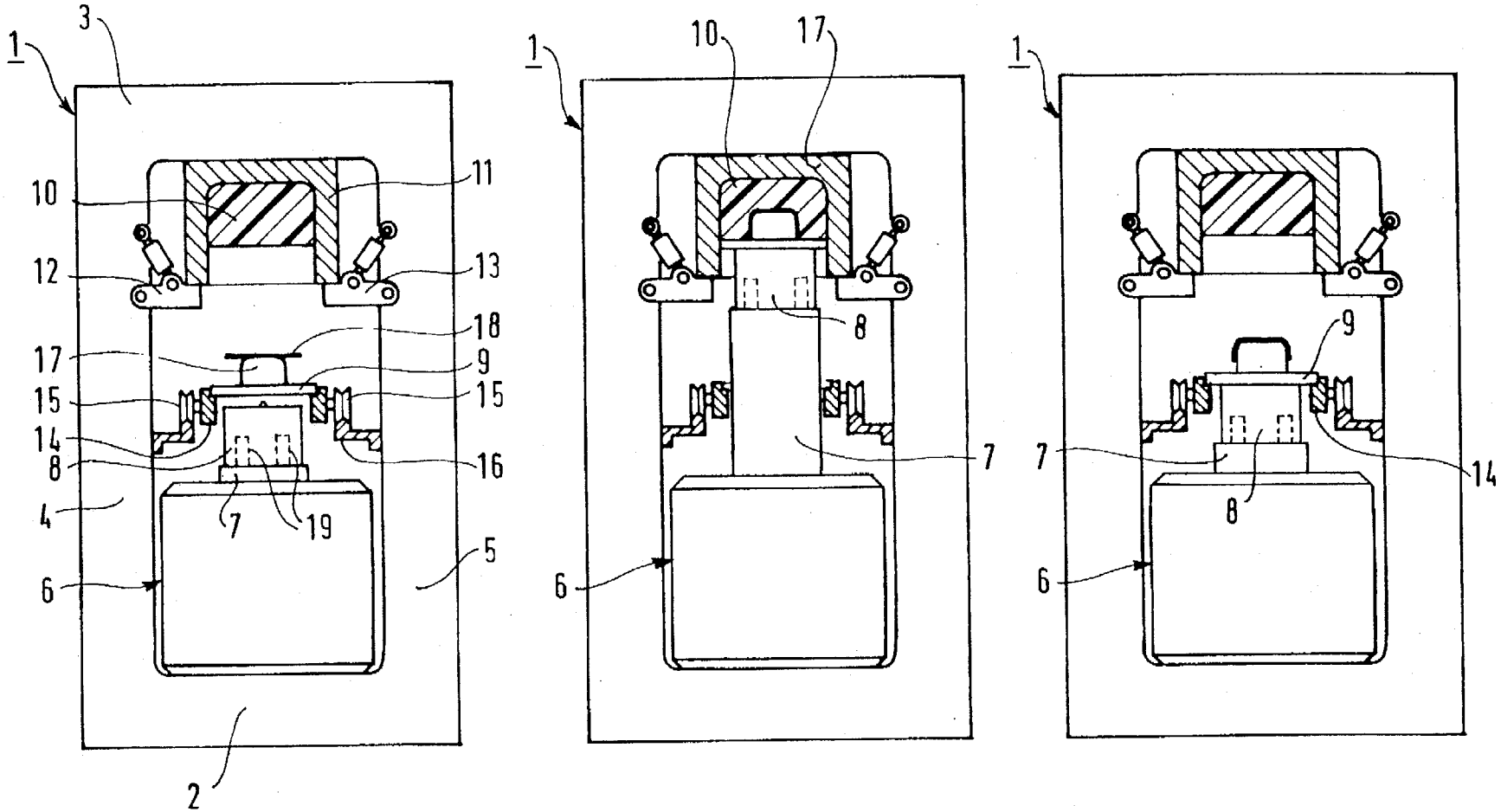
FIG. 1 is a diagram of a forming press of the invention having an elastic matrix.
FIGS. 2 and 3 show a workpiece-forming cycle on a machine of the kind shown in FIG. 1.
Figures 4, 5, 6:
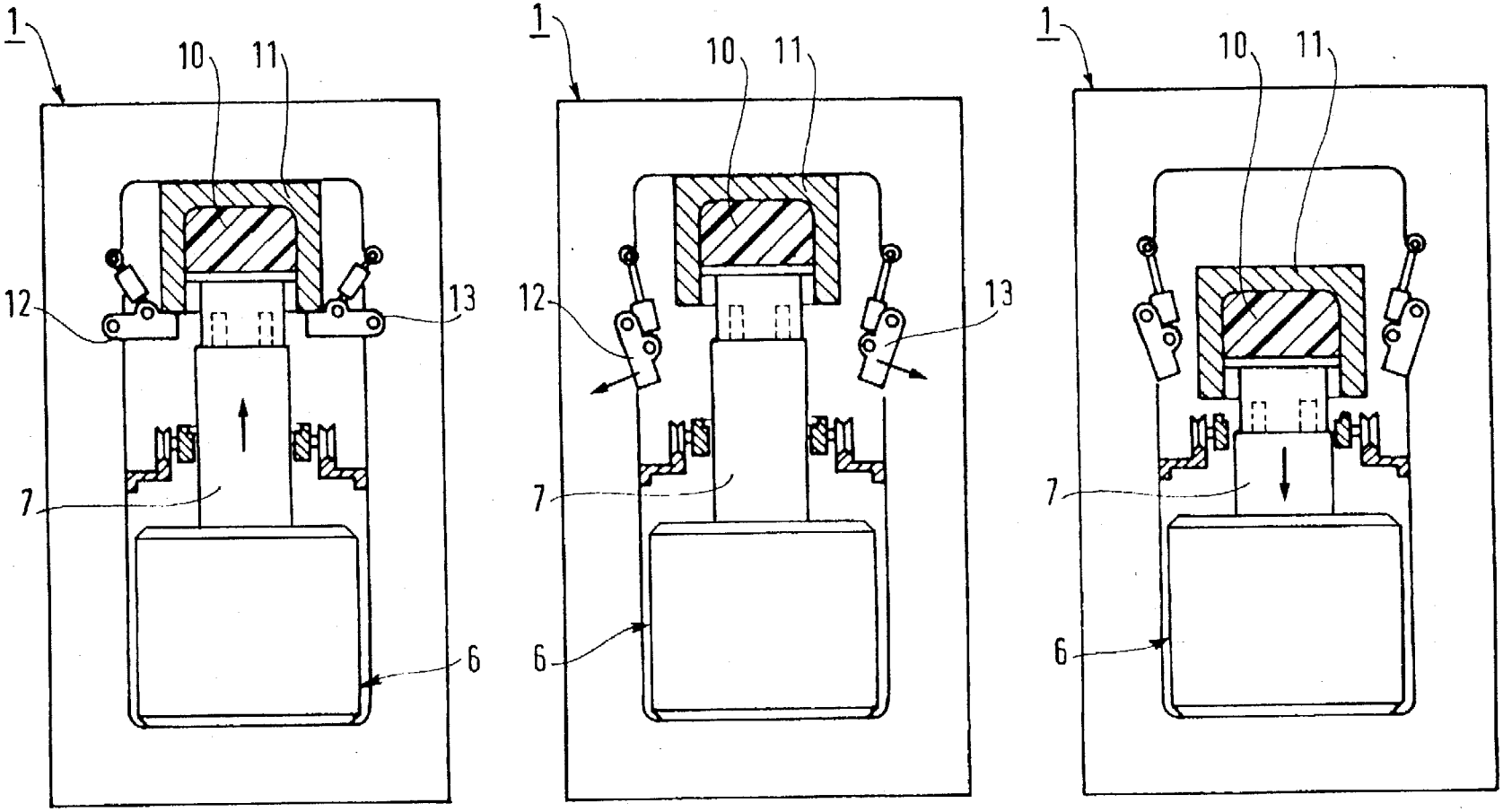
FIGS. 4 to 11 show a cycle of exchanging one forming assembly for another.

With reference to FIG. 1, there can be seen a diagram of a forming press having an elastic matrix. It comprises a frame 1 having a bottom beam 2, a top beam 3, and uprights 4 and 5 interconnecting the beams. An actuator 6 including a piston 7 bears against the bottom beam 2.

According to the invention, the press includes a forming assembly that is removable, enabling it to be exchanged for another. The forming assembly comprises an anvil 8, a tool-carrier table 9, an elastic cushion 10, and a container 11 therefor.

The container 11 bears against the top beam 3 and it is held in place by latches 12 and 13.

The anvil 8 rests on the piston 7 of the actuator. In the rest position of the machine, with the actuator piston in its low position, as shown in FIG. 1, the tool-carrier table 9 rests on an annular cradle 14 which itself rests via wheels 15 on rails 16 connected to the frame 1.

This disposition makes it possible to disengage the tool-carrier table 9 from the machine by running along the rails in order to place thereon a forming tool 17 and the sheet 18 to be formed, and to remove therefrom the formed workpiece, and also to replace the tool 17 with another tool of some other shape, should that be necessary.

Figure 12A:
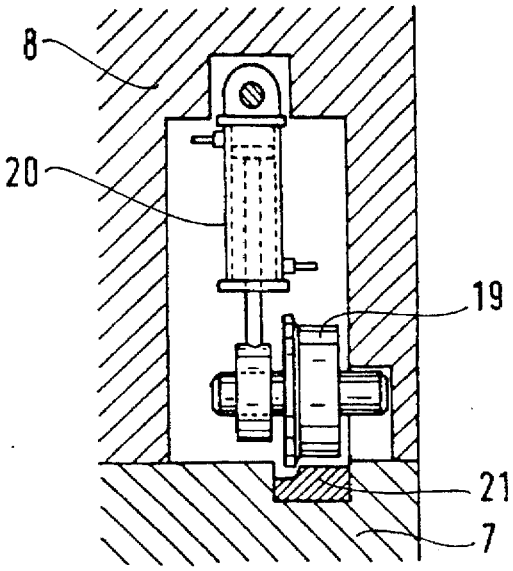
FIGS. 12A and 12B show a detail of the press of the invention on a larger scale and in two different positions.
Figure 12B:
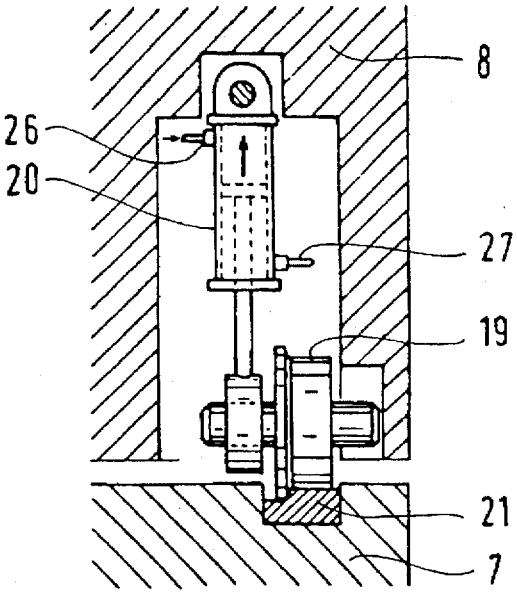

To enable one forming assembly to be replaced by another, the anvil 8 is fitted with retractable wheels 19 mounted on actuators 20 (see FIGS. 12A and 12B).

In FIG. 12A, there can be seen a wheel 19 in its retracted position inside the anvil 8.

In FIG. 12B, the actuator 20 has been actuated and the wheel 19 lowered until it bears against a guide rail 21 and then lifts the anvil 8 from its engagement on the piston 7.

Figure 13:
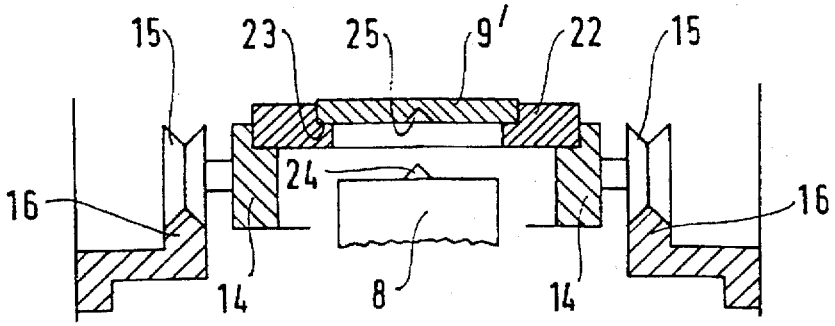
FIG. 13 is a detail view on a larger scale showing how the tool-carrier table is supported on its cradle via an adapter ring.

FIG. 13 is a detail view showing how a tool-carrier table 9 is carried by its cradle 14 via an adapter ring 22 if the tool-carrier table 9' is smaller than the support surface 23 of the cradle 14. In this figure, there can also be seen one of the two centering cones 24 of the anvil 8 for co-operating with two conical holes 25 in the table 9 when the piston rises so as to position the tool-carrier table properly on the anvil 8.

FIGS. 2 and 3 show a workpiece-forming cycle. After a forming tool 17 and a sheet 18 to be formed have been placed on the table 9, as shown in FIG. 1, pressure is applied to the actuator so that its piston 8 rises and engages the assembly 18, 17 in the elastic matrix 10 (FIG. 2) which presses the metal sheet 18 against the forming tool 17 by exerting pressure that is substantially normal to the walls, as though it were more or less a liquid.

Once the workpiece has been formed, the piston is lowered again (FIG. 3) until it has returned to its starting position with the tool-carrier table 9 resting on the cradle 14.

FIGS. 4 to 11 show a cycle in which one forming assembly is replaced by another where the size of the tool-carrier table 9 is smaller, and thus the section of the elastic cushion 10 and the inside section of the container 11 are also smaller.

In a first step (FIG. 4), the actuator 6 is operated so as to raise the piston 7 until the tool-carrier table (with no tool placed thereon) comes into contact with the elastic cushion 10.

Figure 8:
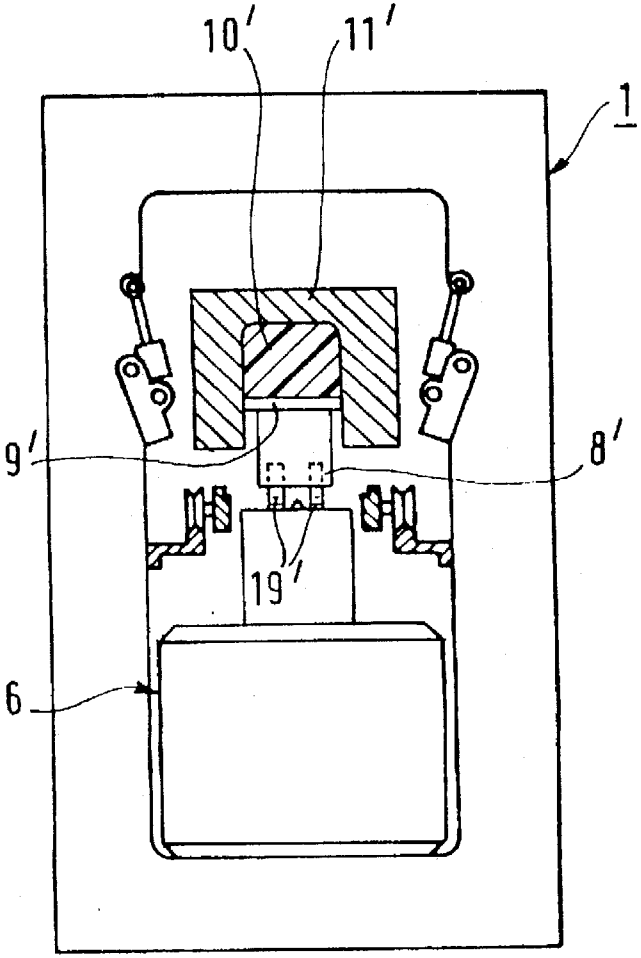
Figure 7:
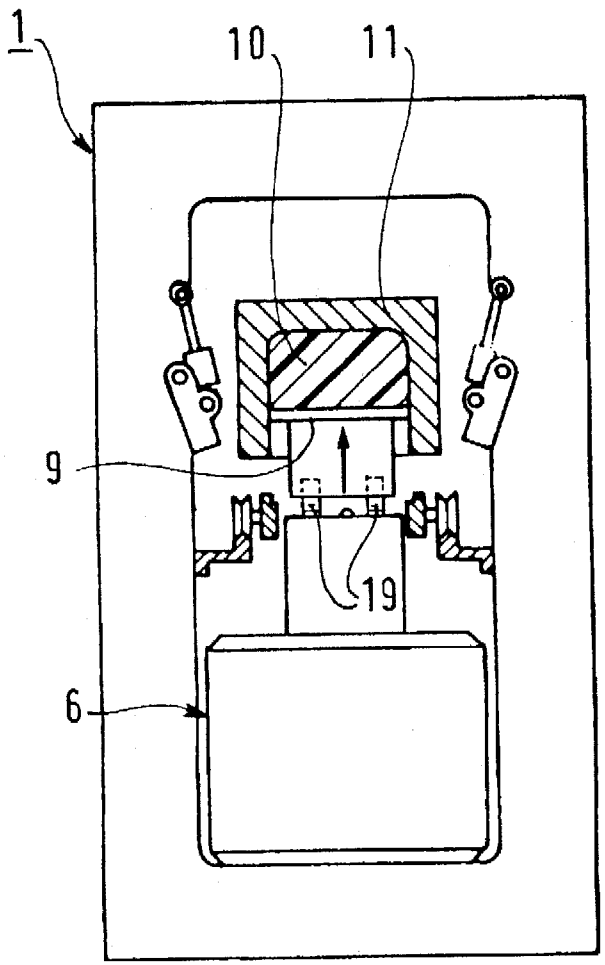
Figure 11:
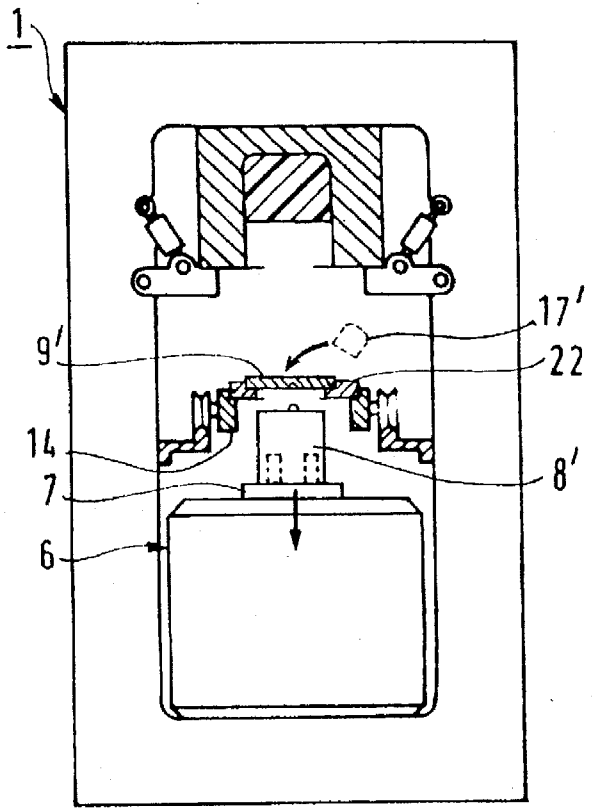
Figure 10:
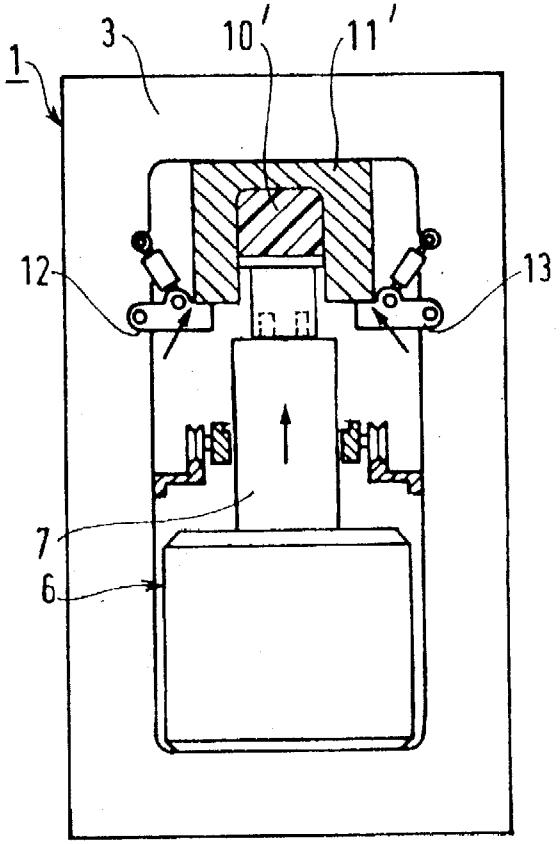
Figure 9:
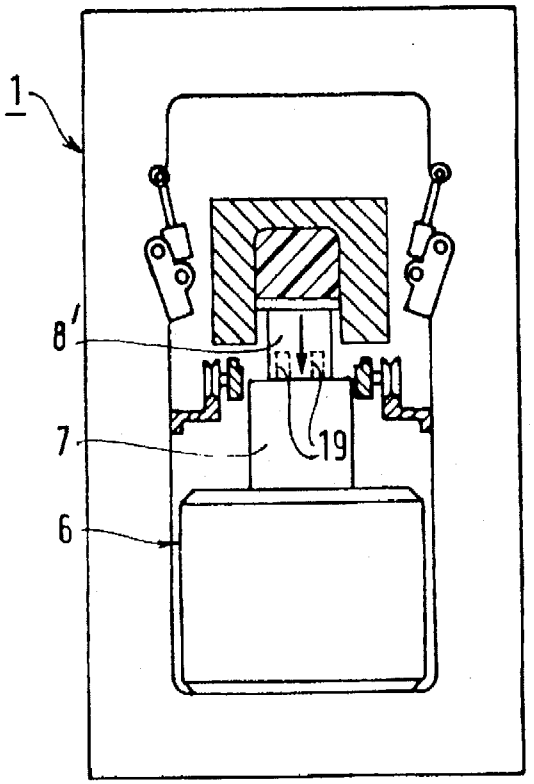

Thereafter (FIG. 5), the latches 12, 13 are released. The entire assembly is lowered (FIG. 6) and then the wheels 19 in the anvil are extended (FIG. 7) by feeding the actuator 20 of each wheel via feed inlet 26 (FIG. 12B), thereby lowering the wheels 19 until they engage the rail 21 and subsequently lift the anvil 8. It is then possible to remove the forming assembly (anvil 8, tool-carrier table 9, elastic cushion 10, and container 11) by causing it to run on the rails 21, after which it can be replaced by another assembly 8', 9', 10', 11' (FIG. 8).

The actuators 20 of the wheels 19 are exhausted (FIG. 9) via actuator duct 27 (FIG. 12B) so that the forming assembly is again supported via its anvil 18 on the piston 7.

The new forming assembly is then raised (FIG. 10) until the container 11' comes into engagement against the top beam 3, and the latches 12, 13 are closed.

Finally, the piston 7 is fully lowered (FIG. 11); and the tool-carrier table 9' then rests on the cradle 14 via the adapter ring 22 that must previously have been put into place.

I claim:

1. An elastic matrix forming press, comprising:

a frame including at least a bottom beam and a top beam united by a link means;

an actuator having a piston, said actuator bearing against said bottom beam;

a forming assembly comprising an anvil resting on said piston of the actuator, a container engaged against said top beam, said container having an inside cross-sectional area and containing an elastic cushion, and a tool-carrier table disposed between said anvil and said elastic cushion, said tool-carrier table having a cross-sectional area corresponding to said inside cross-sectional area of said container; and means attached to said frame for enabling said forming assembly to be exchanged for a different forming assembly having a container of different cross-sectional area and a tool-carrier table of cross-sectional area corresponding to the cross-sectional area of the container in said different forming assembly.

2. A forming press according to claim 1, wherein said means for enabling exchange further comprises guide rails attached to said frame and wherein the anvil is fitted with running wheels including means enabling said running wheels to be placed in one of a retracted position within the anvil or in an extended position where said running wheels rest on said guide rails attached to said frame.

3. A forming press according to claim 1, wherein said means for enabling exchange further comprises releasable latches attached to said frame and said container is held fixed to said frame by said releasable latches.

4. An elastic matrix forming press, comprising:

a frame including at least a bottom beam and a top beam united by a link means;

an actuator having a piston, said actuator bearing against said bottom beam;

a forming assembly comprising an anvil resting on said piston of the actuator, a container engaged against said top beam, said container having an inside cross-sectional area and containing an elastic cushion, and a tool-carrier table disposed between said anvil and said elastic cushion, said tool-carrier table having a cross-sectional area corresponding to said inside cross-sectional area of said container; and means attached to said frame for enabling said forming assembly to be exchanged for a different forming assembly having a container of different cross-sectional area and a tool-carrier table of cross-sectional area corresponding to the cross-sectional area of the container in said different forming assembly, wherein said means for enabling exchange further comprises a set of rails attached to said frame, and an annular cradle having wheels connected to said rails, whereby said tool-carrier table rests on said annular cradle.

5. An elastic matrix forming press, comprising:

a frame including at least a bottom beam and a top beam united by a link means;

an actuator having a piston, said actuator bearing against said bottom beam;

a forming assembly comprising an anvil resting on said piston of the actuator, a container engaged against said top beam, said container having an inside cross-sectional area and containing an elastic cushion, and a tool-carrier table disposed between said anvil and said elastic cushion, said tool-carrier table having a cross-sectional area corresponding to said inside cross-sectional area of said container; and means attached to said frame for enabling said forming assembly to be exchanged for a different forming assembly having a container of different cross-sectional area and a tool-carrier table of cross-sectional area corresponding to the cross-sectional area of the container in said different forming assembly, wherein said carrier-table includes an adapter ring into which said carrier-table is secured, said adaptor ring having a sufficient cross-sectional area to rest in said cradle.

6. An elastic matrix forming press, comprising:

a frame including at least a bottom beam and a top beam united by a link means;

an actuator having a piston, said actuator bearing against said bottom beam;

a forming assembly comprising an anvil resting on said piston of the actuator, a container engaged against said top beam, said container having an inside cross-sectional area and containing an elastic cushion, and a tool-carrier table disposed between said anvil and said elastic cushion, said tool-carrier table having a cross-sectional area corresponding to said inside cross-sectional area of said container; and means attached to said frame for enabling said forming assembly to be exchanged for a different forming assembly having a container of different cross-sectional area and a tool-carrier table of cross-sectional area corresponding to the cross-sectional area of the container in said different forming assembly, wherein said means for exchanging includes guide rails attached to said frame between said tool-carrier table and a resting position of said actuator.

* * * * *